US005225874A

United States Patent [19]

Koh et al.

[11] Patent Number: 5,225,874

[45] Date of Patent: Jul. 6, 1993

[54] IMAGE FIXING APPARATUS HAVING A PULSEWISELY ENERGIZED HEATER

[75] Inventors: Shokyo Koh, Yokohama; Yoshihiko Suzuki, Tokyo, both of Japan

[73] Assignee: Canon Kabushiki Kaisha, Tokyo, Japan

[21] Appl. No.: 440,678

[22] Filed: Nov. 24, 1989

[30] Foreign Application Priority Data

Nov. 25, 1988 [JP] Japan ..... 63-297476
Nov. 25, 1988 [JP] Japan ..... 63-297477
Mar. 31, 1989 [JP] Japan ..... 1-80377

[51] Int. Cl.[5] ..... G03G 15/20

[52] U.S. Cl. ..... 355/285; 219/216; 219/492; 219/497; 219/501

[58] Field of Search ..... 355/206, 282, 285, 290; 219/216, 492, 497, 501, 494

[56] References Cited

U.S. PATENT DOCUMENTS

| | | | |
|---|---|---|---|
| 3,586,830 | 6/1971 | Leitner et al. | 219/497 X |
| 3,810,735 | 5/1974 | Moser | 219/216 Y |
| 3,863,140 | 1/1975 | Easter et al. | 323/288 |
| 4,340,807 | 7/1982 | Raskin et al. | 219/497 |
| 4,374,321 | 2/1983 | Cunningham et al. | 219/497 |
| 4,566,779 | 1/1986 | Coli et al. | 355/3 R |
| 4,660,057 | 4/1987 | Watanabe et al. | 219/497 X |
| 4,661,765 | 4/1987 | Bando et al. | 323/241 |
| 4,740,671 | 4/1988 | Kuroda et al. | 219/492 |
| 4,811,828 | 5/1974 | Ohta et al. | 432/227 |

FOREIGN PATENT DOCUMENTS

| | | | |
|---|---|---|---|
| 0295901 | 12/1988 | European Pat. Off. | 355/285 |
| 0362791 | 4/1990 | European Pat. Off. . | |
| 0370519 | 5/1990 | European Pat. Off. . | |
| 3330407 | 2/1984 | Fed. Rep. of Germany . | |
| 1448641 | 6/1966 | France . | |
| 54-18747 | 2/1979 | Japan . | |
| 57-67970 | 4/1982 | Japan . | |
| 57-67971 | 4/1982 | Japan . | |
| 57-171366 | 10/1982 | Japan . | |
| 58-144868 | 8/1983 | Japan . | |
| 62-40482 | 2/1987 | Japan . | |

*Primary Examiner*—Joan H. Pendegrass
*Attorney, Agent, or Firm*—Fitzpatrick, Cella, Harper & Scinto

[57] ABSTRACT

An image fixing apparatus including a heater having a linear heat generating layer; a film movable together with a recording medium carrying thereon a toner image which is heated by heat generated by the heat generating layer through the film; energizing device for pulsewisely energizing the heat generating layer and for controlling a pulse width of the pulsewise energization in accordance with a voltage level of power supplied thereto.

36 Claims, 6 Drawing Sheets

IMAGE FIXING APPARATUS HAVING A PULSEWISELY ENERGIZED HEATER

FIELD OF THE INVENTION AND RELATED ART

The present invention relates to an image fixing apparatus for fixing a toner image on a recording material, more particularly to an image fixing apparatus for heat-fixing a toner image through a film.

In a conventional image fixing apparatus wherein the toner image is fixed on the recording material, the recording material is passed through a nip formed between a heating roller maintained at a predetermined temperature and a pressing or back-up roller having an elastic layer and press-contacted to the heating roller, the recording medium supporting an unfixed toner image.

The conventional image fixing system of this type requires that the heating roller be maintained at an optimum temperature to prevent high temperature toner off-set and low temperature toner off-set. To meet this requirement, the thermal capacity of the heating roller is large, with the result of a longer warming period for heating the heating roller up to the fixing temperature.

In order to solve the problem of the long warming period, U.S. Ser. No. 206,767 filed Jun. 15, 1988 which has been assigned to the assignee of this application proposes an image fixing apparatus using a fixed heater having a low thermal capacity and a thin film. In this apparatus, a heat generating layer having a low thermal capacity is pulsewisely energized, by which it is instantaneously heated up to a high temperature. In addition, in order to prevent the variation of the heat temperature when it is heated, the pulse width is controlled. If, however, the input voltage varies in this apparatus, the electric power applied to the heat generating layer varies with the result that the same control before the input voltage variation is not proper. In addition, the resistance of the heat generating layer varies depending on individuals, which variation makes it difficult to perform the same control. Furthermore, with the increase of the duty ratio of the energization pulse due to erroneous operation of the control circuit, the situation becomes the same as when the heat generating layer is always energized, so that the overheating of the resistor can not be prevented. If this occurs, the resistance material is broken.

SUMMARY OF THE INVENTION

Accordingly, it is a principal object of the present invention to provide an image fixing apparatus wherein the image fixing operation can be performed stably even if the input voltage varies.

It is another objct of the present inveton to proivde an image fixing apparatus wherein the image fixing operation can be performed stably irrespective of the ariation of the resistance of th heat genrating layer.

It is afurther object of the pesnet invnetion to provide an image fixing apparatus wherein the energization can be stopped in accordance with the energiztaion time and period of the energization pulse.

In one aspect there is proivded an image fomring apparatus with a heater having a linear heat generaing layer, a film movable together with a recording medium carrying thereon a toner imeage which is heated by heat generated by the heat generation layer through the film, a power source, and a power supply for suppyling electric power from the power source to the heat generating layer, the power supply controllinfg the power supply in accordance with a voltage thereof.

In anotehr aspect thereis provdied an image fixin apapratus with a heater having alinear heat genraitng lyaer, carryign thereon a toner image which is heated by heat generated by the heat generating layer through the film, an energizer for pulsewissely energizing the heat generating layer, the energizer supplying power to the heat generating alyer in the form of pulses having the same pulse width irresepctive of the temperturae of the heater during energization, and an adjuster for adjusting a pulse width of the pulsewise energiztaion.

In yet another asepct there is providied an image fixing apparatus with a heater having a lniear heat generating layer, a film movable together with a recording material carrying thereon a toner image which is heated by heat generated by the heat genrating laye thorugh the film, an erergizer for pulsewisely energizing the heat generingt alyer, and a temperature detector for detecting a tmepature of siad heater, wherin the erergizer controls a period of the energization pulse in accordance with an output of the tmeperaure detector and wherien a conveyirng speed Vp of the recording mateial, a width d of siad heat generating layer and energiztion period Tmax in which a minimum energy is supplied, satisfy the formula:

$$Vp \times Tmas \leqq d.$$

In still yet another asepct there is provded an image fixing apparatus with a heater, a film movable togehter with a recording material carrying thereon a toner image which is heated by heat generated by the ehater through the film, a power supply for supplying power to theheat generagting layer; a controller for controlling power supply to the heat generaign layer by the power supply, and a shutting means for shutting power supply to the heater by the power supply, wherein the shutting means shuts the power supply to siad heater in accordane with power by siad supply means.

These and other objcts, features and advantages of the pesetn invention wil lbecome more aparent upon a consideration of the folloiwng description of the preferred emboidmnets of the prsent invnetion taken in conjunction with the accompnaying drawings.

BRIEF DESCRIPTION OF THE DRAIWNGS

DESCRIPTION OF THE PREFERRED EMBODIMENTS

Figure 1:
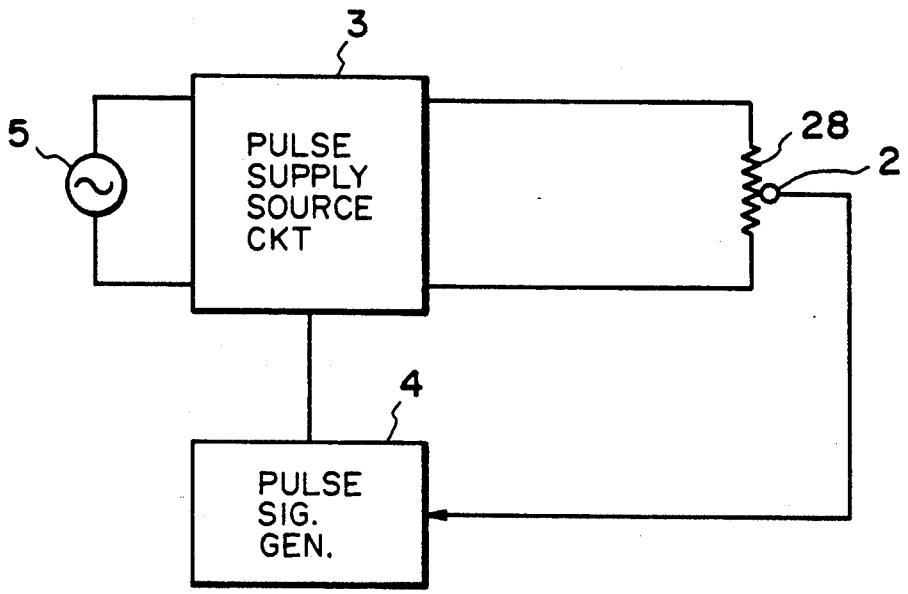
FIG. 1 is a block diagrm of a control system used in an emboidment of the persent inventon.

The embodiments of the present invention will be described in conjunction with the accompanying drawings wherein like reference numerals are assigned to the elements having the corresponding functions.

Figure 2:
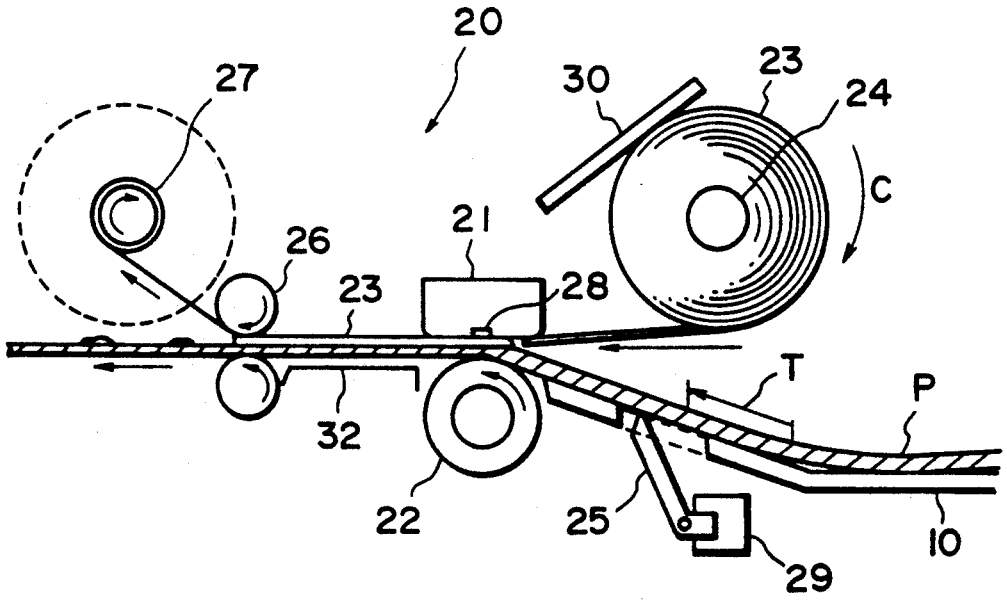
FIG. 2 is a sectional view of an image fixing apparatus acording to an emboidment of the present inventon.

Referring to FIG. 1, a block diagram used with an image fixing apparatus according to an embodiment of the present invention is shown, and FIG. 2 shows a sectional view of an image fixing apparatus according to the embodiment of the present invention.

In FIG. 2, an image fixing apparatus 20 comprises a heater 21, fixedly supported. The heater 21 includes a base member made of electrically insulating and heat-resistive material such as alumina or the like or a compound material containing it, a heat generating resistance layer 28 in the form of a line or a stripe made of $Ta_2N$ or the like and a surface protection layer resistive against sliding movement, made of $Ta_2O_5$ or the like. The bottom surface of the heater 21 is smooth, and the front and rear portions thereof are rounded to permit smooth sliding of a heat-resistive film 23. The fixing film 23 is made, for example, of PET treated for heat-resistivity having a thickness of approximately 6 microns. It is wound on a film feeding shaft 24. The film is fed out in the direction indicated by an arrow c. The heat resistive film or sheet 23 is contacted to the surface of the heater 21 and is taken up on a film take-up shaft 27 by way of a separating roller 26 having a large curvature.

A heat generating layer 28 of the heater 21 has a small thermal capacity, and is pulsewisely energized. The leading and trailing edges of a transfer material P are detected by a transfer material detecting lever 25 and a transfer material detecting sensor 29. In response to the detections, the heat generating layer 28 is energized upon necessity. The energization of the heater 21 may be controlled in accordance with position detection of the transfer material P using a sheet feed sensor of an image forming apparatus with which the image fixing apparatus is used. On the other hand, the back-up roller 22 includes a core made of metal or the like and an elastic layer made of silicone rubber or the like. It is driven by an unshown driving source and is pressed to the heater 21 through the heat-resistive film 23 moving at the same speed as the transfer material P advanced along a conveyance guide 10 and having the unfixed toner image T. The conveyance speed of the pressing roller 22 is preferably substantially the same as the conveyance speed of the sheet during the unfixed toner image formation on the transfer material. The heat-resistive sheet 23 speed is determined following this speed. Designated by reference numerals 30 and 32 are a heat-resistive sheet sensor and a guide, respectively.

In the image fixing apparatus 20 having the structure described above, the toner image T made of heat-fusible toner on the recording sheet P is first heated and fused by the heater 21 through the heatresistive heat. At this time, the back-up roller 22 establishes close contact between the heater 21, the heat-resistive sheet 23, the toner image T and the recording sheet P, so that the heat transfer is efficient.

Thereafter, the recording sheet P is continued to advance and is separated from the heater 21, by which the heat of the toner image T is radiated so that the toner image T is cooled and solidified. Then, the heat-resistive sheet 23 is separated from the recording sheet P by the separating roller 26 having a large curvature.

The toner image T is once completely softened and fused, and then is solidified, and therefore, the coagulation force of the toner is very strong, and the toner behaves as a mass. In addition, since the toner is pressed by the back-up or pressing roller 22 when it is softened and fused by heat, at least a part of the toner image T soaks into the surface layer of the recording sheet P, and is then cooled and solidified. This permits the toner image T to be fixed on the recording sheet P without toner off-set to the heat resistive sheet 23.

Referring back to FIG. 1, the control system includes a temperature detecting thermister for detecting the temperature of the heat generating layer 28. An output of the thermister 2 is transmitted to a pulse signal generator 4 which controls the pulse signal to maintain a constant temperature of the heat generating layer 28. A power source circuit 3 supplies pulsewise power connected with utility AC source 5, the power from which is rectified and is supplied to the heat generating layer 28. In accordance with the rising of the pulse signal provided by the pulse signal generator 4, the heat generating layer 28 is energized for a predetermined pulse width determined by the circuit. In other words, the pulse signal generating device 4 changes the period of the output pulse signal to control the power to be supplied to the heat generating layer 28, so as to maintain a constant temperature of the heater 21. At this time, the relationship between the period of the pulse signals and the applied power is such that when the periods are $\tau$, $2\tau$ and $4\tau$the applied powers are Wo, Wo/2 and Wo/4. When the input power is controlled by changing the period of pulse signal, it is desirable that any position of the recording material P is heated by the heat generating layer 28 when it is energized. To accomplish this, the energization pulse period $T_{ON}$ is determined so as to satisfy:

$$(Vp)(Tmax) \leqq d$$

where Tmax is a maximum energization period, that is, the energization period in which minimum energy Wmin is applied when the temperature control is effected to the heat generating layer 28; Vp is a conveying speed of the recording material P; and d is a width of the heat generating layer 28.

Figure 3:
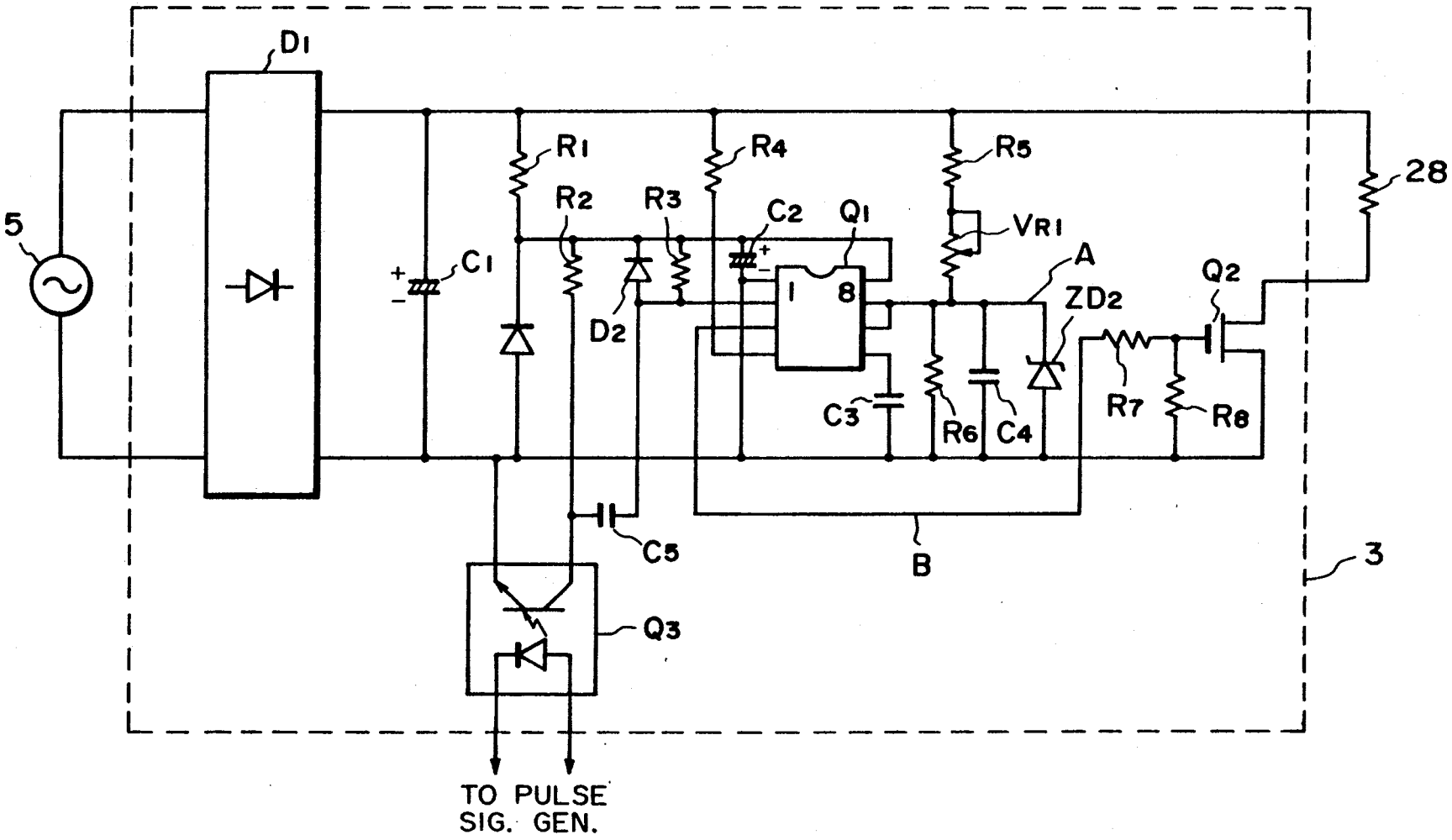
FIG. 3 shows details of a pulse supply source circuit of FIG. 1.

Referring to FIG. 3, there is shown details of the pulse supply source circuit of FIG. 1. The circuit includes resistors R1, R2, R3, R4, R5, R7 and R8, and capacitors C1, C2, C3, C4 and C5. The capacitor C1 constitutes a rectifying circuit together with a diode D1. The signal from the pulse signal generating circuit is applied through a photocoupler Q3.

The circuit comprises a switching FET (field effect transistor) Q2, which is driven by a timer (IC) Q1. The resistors R2 and R3 and the capacitor C5 constitute a differentiating circuit together with a diode D2. By employing the differentiating circuit as the input means, the energization beyond a predetermined pulse width is prevented even if the onsignal is always applied to the pulse signal generating device 4. The timer (IC) Q1 constitutes a mono-stable multi-vibrator. The pulse width of the output thereof is defined by the resistors R5 and R6, a resistor VR1 and a capacitor C4. The charging property of the combination of the resistors and the capacitor, and the reference voltage source ZD1 determine the energization pulse width.

Figure 4:
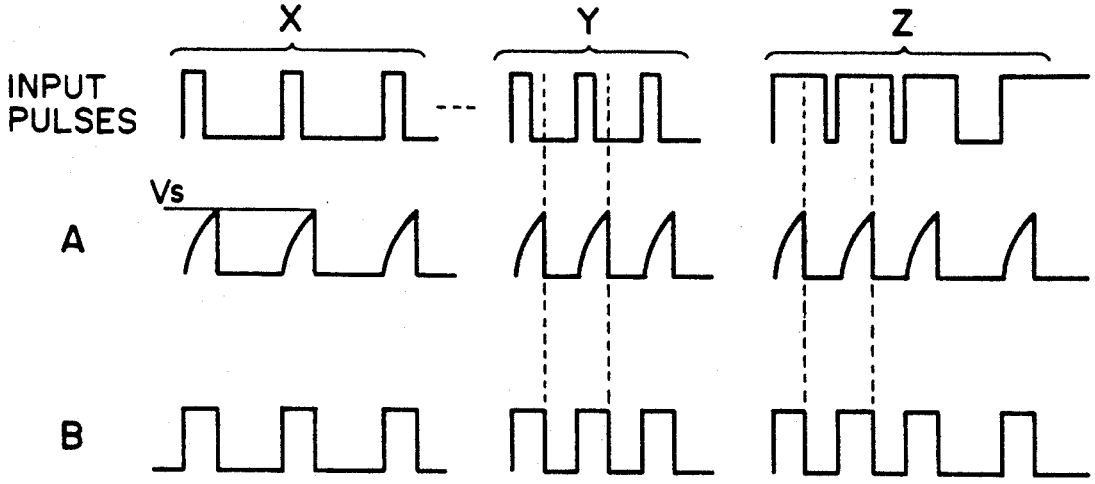
FIG. 4 illustrates the power supply control in the apparatus of FIG. 1.

Referring to FIG. 4, the operation for this will be described, using an input pulse signal and voltages at points A and B. In FIG. 4, when a pulse signal is inputted, the voltage at the point B becomes "H" at the rising time, and the capacitor C4 starts to be charged with a time constant $\tau_1$ determined by the resistors R5, R6 and VR1 and the capacitor C4. When the voltage at the point A increases up to a threshold voltage level Vs determined by the reference voltage source ZD2, the voltage at the point B becomes "L", and the capacitor C4 is discharged. The time when the voltage at point B becomes "H" is determined by the pulse power supply source circuit 3 irrespective of the output pulse of the pulse signal generating circuit. The control of the power application to the heat generating layer 28 is effected by changing the periods of the pulse signals (X and Y in FIG. 4).

As shown by the pulse signal Z in FIG. 4, even when the on-pulse signals are excessive or are always on due to erroneous operation of the pulse signal generating circuit, the energization period is the same as in the normal condition. That is, the pulse power supply source circuit 3 functions also as a safety circuit for limiting the energization pulse width.

The description will be made as to the energization pulse width of the pulse supply source circuit 3 when the voltage of the utility or commercial power source 5 changes. When the voltage of the source 5 changes, the voltage Vc across the rectification smoother capacitor $C_1$ changes. The voltage change at the point A at this time is shown in FIG. 5.

Figure 5:
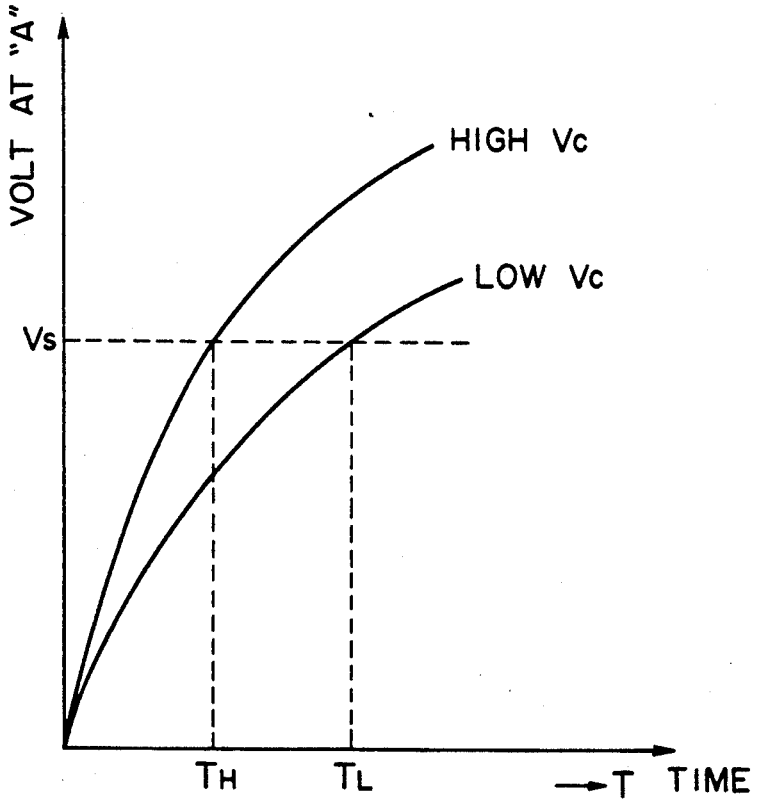
FIG. 5 illustrates a principle of correcting the voltage variation.

As will be understood from FIG. 5, when the input voltage is high, the time required for the threshold voltage Vs to be reached is short, while ,on the other hand, when it is low, the time required therefor is long. The heater 21 is energized until the voltage at the point A increases from zero to the level Vs, and therefore, the energization period is short when the input voltage is high, whereas when the input voltage is low, the energization period is long. If the threshold voltage Vs, the resistance and the capacitor influential to the energization period are selected so that the power supplied to the heater 1 is constant even when the voltage Vc changes, under the condition that the pulse signal generator 4 produces periodical pulses with constant periods, the pulse signal generating circuit can effect the constant control irrespective of the variation of the input AC voltage.

Where the resistances of the heat generating layers 28 are varied due to the variation in the manufacturing error of the heat generating resistors 28, the power supply to the heat generating layer 28 changes even if the same pulse energization is effected from the pulse supply source circuit 3. However, the pulse signal generating circuit can perform the constant control even when the heat generating layer 28 has a different resistance, by adjusting the resistor $VR_1$ in accordance with the resistance of the heat generating layer 28 to change the time constant $\tau_1$ of the charging circuit so that when the resistance of the heat generating layer 28 is large the time required for reaching the threshold level Vs is long, and when it is small, the time required therefor is short.

In the pulse supply source circuit 3 of this embodiment, as described hereinbefore, the energization pulse width changes so that the power supplied to the heat generating layer 28 is constant. Since, however, it is not possible to enlarge the energization pulse width beyond 100 % of the pulse duty ratio Dp, the input voltage and the resistance of the heat generating layer 28 can not be corrected, as the case may be, and therefore, the desired energy can not be supplied. In consideration of this, the central value of the resistance of the heat generating layer 28 is limited in the following manner.

The maximum required power Wmax during the temperature control of the heat generating layer 28, a voltage Vco which is the voltage of Vc when the utility AC voltage takes the reference level, a voltage Vcmin which is the voltage of Vc when the AC voltage is minimum, the central value RLO of the resistance of the heat generating layer, a maximum resistance RLmax of the resistance of the heat generating layer 28 due to the manufacturing variation, a pulse duty ratio Dpo providing the maximum power Wmax when the voltage is Vco, and the central value is RLO, and a pulse duty ratio Dpmax providing the maximum power Wmax when the voltage is Vcmin, and the central value is RLmax, are to satisfy:

$$(Vcmin)^2/RLmax \geqq (Vcmin)^2 Dpmax/RLmax = (Vco)^2 Dpo/RLO$$

This is because the controllable range is defined by Dpmax≦100 %.

Then, the following results:

$$(Vcmin/Vco)^2(RLO/RLmax) \geqq Dpo$$

When the pulse duty ratio Dpo is determined, the central value RLO of the resistance of the heat generating layer 28 is:

$$RLO=[(Vo)^2.Dpo]/Wmax$$

Thus, the central value of the heat generating layer 28 is determined on the basis of the pulse duty ratio Dpo and the maximum required power Wmax. In the experiments, $$Vcmin=106\ V$$

$$Vco=128\ V.$$

When the reference level of the input AC voltage was 100 V, the minimum level thereof was 85 V, the variation of the resistance was within 10 %, and the maximum required power Wmax was 400 W.

Therefore, Dpo≦62 %.

At this time, RLO≦25.39 ohm.

In this embodiment, the power source circuit for supplying pulsewise power in synchronism with an output of the control circuit; a charging circuit including a capacitor and resistance is provided in the power source circuit; when the input AC voltage changes, the charging property of the charging circuit changes; the pulsewise energization period changes in accordance with the change in the charging property; and in the control circuit, the output pulse period is changed to control the heater temperature. Therefore, even if the input voltage changes, the change can be easily compensated by the same control means.

In addition, the energization period of the power source circuit for the pulsewise energization in synchronism with an output signal of the pulse signal generator 4 is adjustable in accordance with the resistance of the heat generating layer 28, and the control is effected by changing the output pulse period of the pulse generator 4. Therefore, the variation in the resistances in the heat generating layers 28 can be easily compensated.

Figure 6:
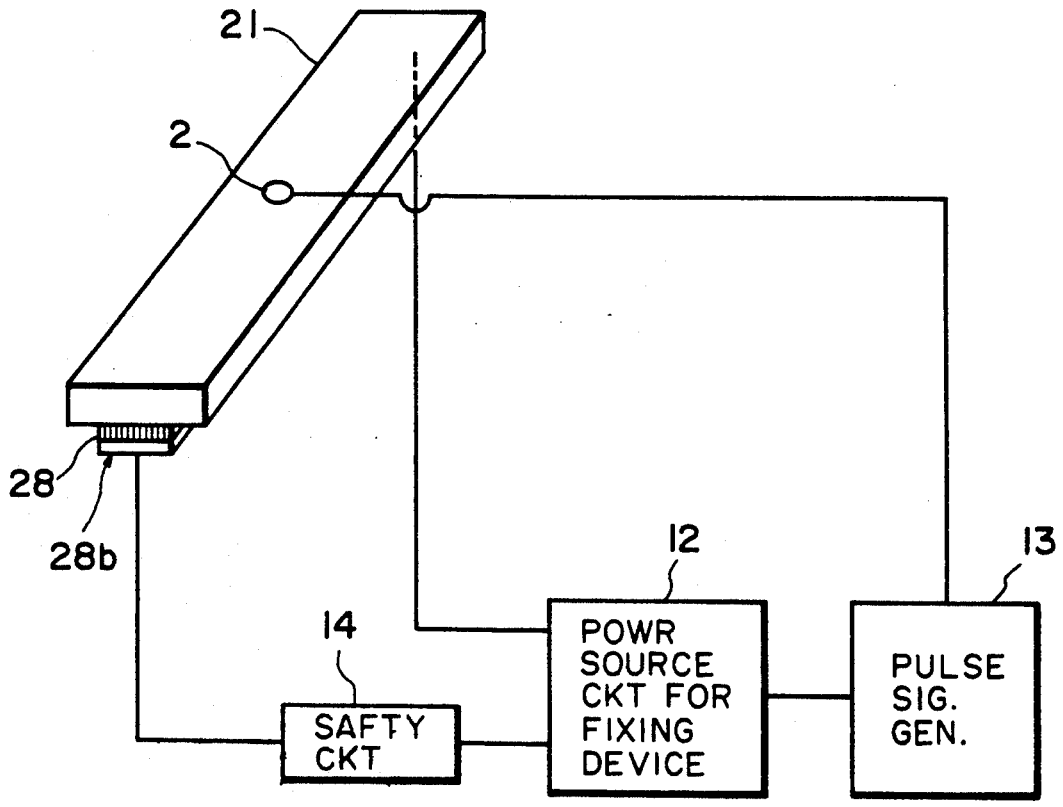
FIG. 6 is a block diagram of a control system for an image fixing apparatus according to another embodiment of the present invention.

Referring to FIG. 6, a further embodiment of the present invention will be described. In this Figure, the fixing apparatus comprises a heater 21 including a heat generating resistor 28 and an electrode 28*b* on a base plate (made of alumina or glass). The heater 21 is supplied with electric power from a power source 12. The apparatus further comprises a pulse generator for generating control signals for pulsewisely energizing the heater 21 in accordance with the temperature of the base plate of the heater 21, a safety circuit 14 for stopping the power supply in accordance with the period of the pulsewise power supply and the pulsewise energization period, and a thermister 2 for measuring the temperature of the base plate and supplying the temperature information to the pulse signal generator 13.

Figure 7:
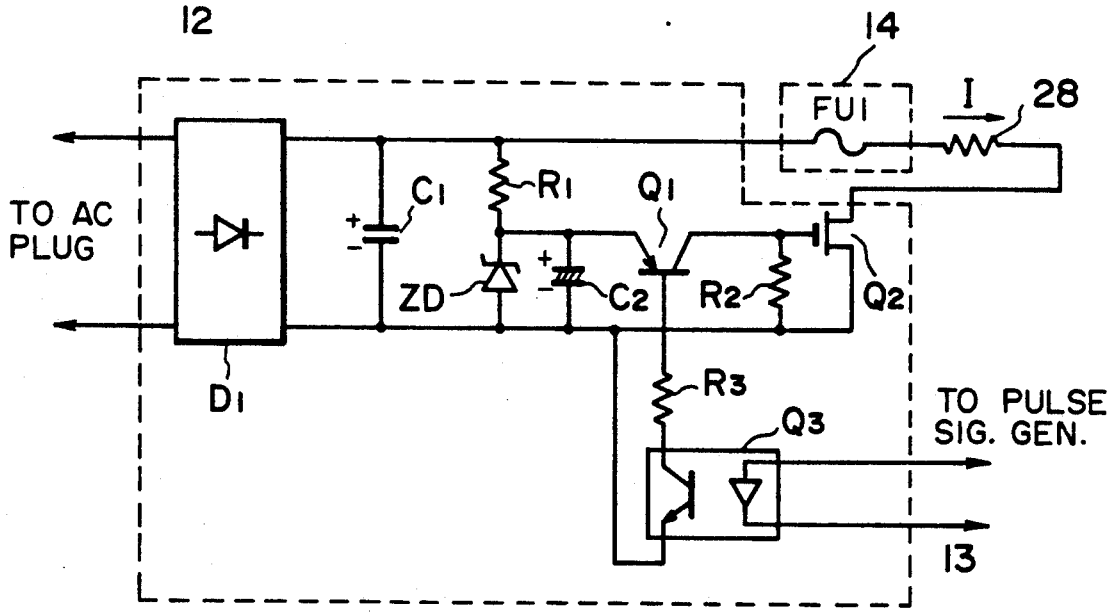
FIG. 7 shows details of a main part of the system shown in FIG. 6.

FIG. 7 shows the details of the power source circuit 12 containing the safety circuit 14 of FIG. 6. In this embodiment, the safety circuit 14 includes a current fuse FU1.

The AC input voltage is rectified by a diode bridge $D_1$, and is smoothed by the capacitor $C_1$. The output signal of the pulse signal generator 13 is supplied to a photocoupler $Q_3$ in the power source 12. In response to the signal, the driving circuit $Q_1$ drives an energization controlling switching element $Q_2$ for supplying power to the heat generating resistor 28 of the heater 21. The pulse signal generator 13 changes the pulse signal in accordance with the output level of the thermister 2 disposed closely to the heater 21 so as to control the power supply to the resistor 28.

When the pulsewise energization is performed, the average current I to the resistor 28 is proportional to a ratio of the pulse energization period and the pulse energization time (pulse duty ratio). The maximum level Imax of the current I is determined by a resistance RH of the resistor 28, a voltage Vc1 across the capacitor $C_1$ and an on-set voltage VDS of the switching element $Q_2$, as follows:

$$Imax=(Vc1-VDS)/RH$$

When the pulse duty ratio Dp, the current I is:

$$I=Imax\times Dp=(Vc1-VDS)Dp/RH$$

Figure 8:
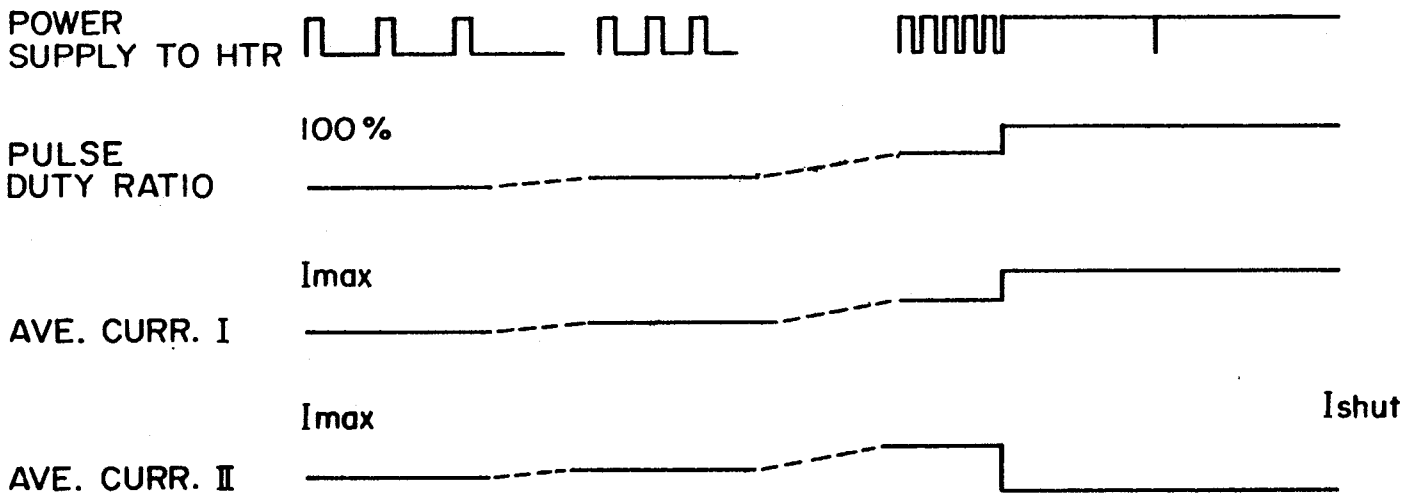
FIG. 8 illustrates the operation thereof.

FIG. 8 shows an operation of the safety circuit 14 described above. In FIG. 8, reference characters A, B and C designate the power supply to the heater with the pulse signals having the duty ratios 20 %, 30 % and 60 %, respectively. The reference character D designates the case wherein the heater is always supplied with power due to erroneous operation of the pulse signal generator 13 or the like. As shown by the average current I in this figure, if the safety circuit 14 is not employed, the current I increases in the order of A, B and C, and the maximum current Imax is reached in the D state. When, on the other hand, the safety circuit 14 of this embodiment is used, the power supply to the heater 21 is shut as indicated by the average current I in FIG. 8. The fuse FU1 blows out when the current is Ishut.

It is preferable that the current Ip at the time of the required maximum duty ratio Dpmax during the pulse energization temperature control operation is smaller than the current Ishut. By doing so, the power supply to the resistor 28 can be made similar to the conventional apparatus under normal conditions, but when the pulse duty ratio becomes large due to an erroneous operation or the like, the fuse FU1 shuts the power supply circuit, thus preventing overheating and the damage of the heat generating resistor 28 of the heater 21.

Figure 9:
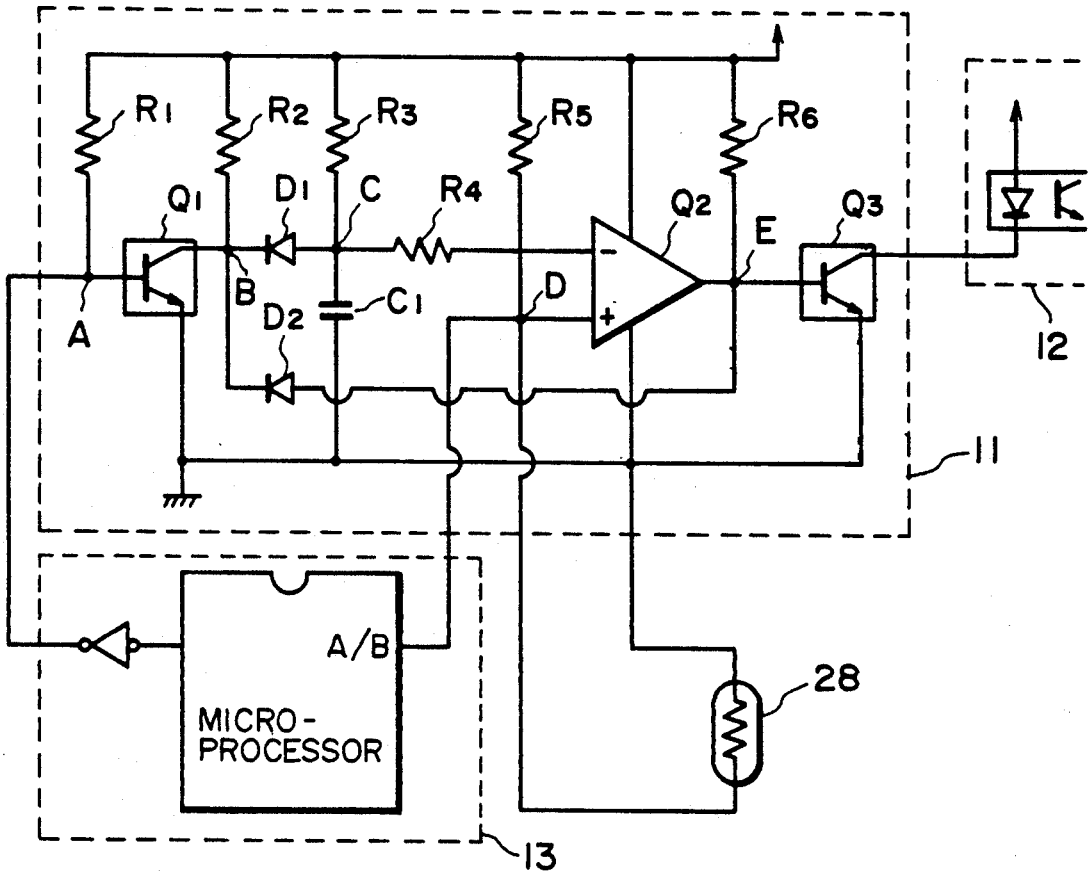
FIG. 9 shows a pulse signal generating device and a pulse width limiting safety circuit used in another embodiment of the present invention.

FIG. 9 shows a pulse width limiting safety circuit 11 which is usable in this embodiment. If this is incorporated in this embodiment, the pulse width limiting safety circuit 11 limits the pulse width in the case of the energization at all times (D of FIG. 8), and therefore the fuse FU1 does not blow out.

Figure 10:
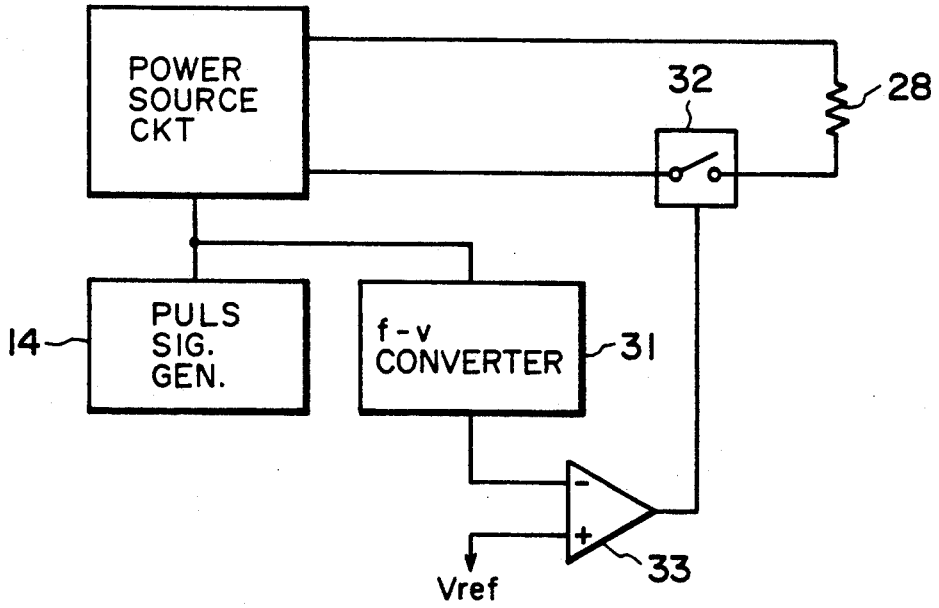
FIG. 10 is a block diagram of a control system according to a further embodiment of the present invention.

FIG. 10 shows a further embodiment of the present invention, wherein in place of the current fuse FU1, the use is made with an f-V converter 31, a switching element 32, a comparator 33 and other elements, by which when the voltage exceeds a predetermined level, the switching element 32 is rendered off. According to this embodiment, the shutting circuit uses a switching element 22 such as a semiconductor or relay or the like, and therefore, there is no necessity of exchanging a part or parts even after the occurrence of the erroneous pulse.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comrsing:

a fixign heater;

a power soruce;

power supply mens for supplying electric power in theform of pulses from siad power source to said fixing heater, said power supply means controlling a width of the pulses in acordance with a voltage thereof; and limiting means for limiting the width of the pulses.

2. An apparatus according to claim 1, further comprising a film movable together with a recording medium carrying thereon a toner image which is heated by heat generated by siad heater through siad fiml.

3. An apparatus acocridng to claim 2, further comprsing pressing means for imparting urging force among siad heater, siad film and the recording mateial.

4. An apparatus according to claim 3, wherein during a fixing operation, there is no air layer between said heat generating layer and the toner image.

5. An apparatus according to claim 2, wherein said heater comrpises a linear heat generating layer for generating heat upon the supply of power thereto.

6. An apparatus according to claim 5, wherein siad heat genrating layer extends in a direction substnatilly pependicuarl to a movemnet dierction of said recording mateiral.

7. An apparatus acocrding to claim 5, wherein siad heater is fixed during its fixing operation, and siad film slides on siad heater.

8. An apparatus according to claim 1, wherein siad supply means supplies the power to siad heat generating layer on the form of pulses, and a width of the pulse is determined by a resistor, a capacitor and a refernece voltage source in accordance with a pulse signal.

9. An apparatus according to claim 1, wherein siad supply measn supplies the power to said heat gneerting layer in the form of pulses, and said suply means controls a pulse width so as to make the power supplied to siad heat generating layer substnaially constant irrespective of the voltage level supplied thereto.

10. An image fixing apparatus, comrising:

a heater having a linear heat generating layer;

a film movabel together with arecording material carrying thereon a toner image which is heated by heat generated by said heat genrating layer through siad fim;

energizing menas for pulsewisely energizing said heat generating layer wherin said enrgizing means supplies power to said heat genrgin alyer in the form of pulses having the same pulse width irrespective of a temperature of said heater during energization by siad energizing means; and adjusting means for adjusting a pulse width of the pulsewise energization.

11. An apparatus according to claim 10, wherein said pulse width is adjusted in accordance with a resistance level of said heat generating layer.

12. An apparatus according to claim 10, further comprising pressing means for imparting urging force among said heater, said film and the recording material.

13. An apparatus according to claim 12, wherein during a fixing operation, there is no air layer between said heat generating layer and the toner image.

14. An apparatus according to claim 10, wherein said heat generating layer extends in a direction substantially perpendicular to a movement direction of said recording material.

15. An apparatus according to claim 10, wherein said heater is fixed during its fixing operation, and said film slides on said heater.

16. An apparatus according to claim 10, wherein siad adjusting measn includes a variable resistor, and wherein the pulse width of the energization is adjustd by changing the resistance of the variable resitro.

17. An image fixing apapraus, comrsing:

a heater having a linear heat genrating layer;

a film movable together with a recording material carrying thereon a toner image which is heated by heat genrated by siad hat generign layer thorugh siad film;

energizing means for pulsewisely energizing siad heat genrgin layer;

temperature detecting measn for detecting a temperaure of siad heater;

wherein siad energizing menas controls a period of the eenergization pulse in accordance with an output of siad temperture detedting measn and wherien a conveying speed Vp of the recordnig mateial, a width of siad heat generaigngg layer d and energiztion period Tmax in which a minimum energy is supplied, satisfy:

$$Vp \times Tmax \leqq d.$$

18. An apparatus according to claim 17, wheein further comirsing pressing measn for imparing urging force among siad heaer, siad film and the recording material.

19. An apparatus according to claim 18, wherein during a fixing operation, there is no air layer between said heat generating layer and the toner image.

20. An apparatus according to claim 17, wherein said heat generating layer extends in a direction substantially perpendicular to a movement direction of said recording material.

21. An apparatus according to claim 17, wherein said heater is fixed during its fixing operation, and said film slides on said heater.

22. An apparatus according to claim 17, wherein said energizing means controls a width of the pulsewise energization.

23. An apparatus according to claim 22, wherein the width of the pulsewise energization is controlled in accordance with variation of a voltage supplied thereto.

24. An image fixing apparatus, comprising:

a fixing heater;

power supply menas for supplying power to said fixin heater;

conrol menas for controlling the duty ratio of the power to said fixing heater by siad power supply means; and shutting measn for shutting off the power supply to siad heater by siad power suppyl means, wherein said shutting means shuts off the power supply to siad heater in accordane with the duty ratio.

25. An apparatus according to claim 24, wherein siad supply means supplies the power in the form of pulses, and said control measn controls width of the pulses.

26. An apparatus according to claim 25, further comrising temerpaue detecting means for detecting a temeprature of siad heaer, and the energization pulse time is changed in accordance with an output of siad temperature detecting means.

27. An apparatus according to claim 25, wherein siad shutting measn shuts the energization when the pulse energization time exceeds a predetermined level.

28. An apparatus according to claim 24, wherein siasd shutting measn is disposed in a power supply passage by siad energizing means to siad heater, and it shuts the power supply by opening the passage.

29. An apparatus according to claim 24, further comprising af ilm movable together with a reording medium carrying thereon a toner image which is heated by heat generated by siad heater through siad film.

30. An apparatus according to claim 29, wherein said heater includes a ilnear heat generating layer.

31. An apparatus according to claim 30, whrein further comirsing pressing measn for imparting urging force among siad heater, siad film and the recording material.

32. An apparatus according to claim 30, wherin siad heat genrign layer extends in a direction substatially perpendicualr to a movement dierction of isad reording mateiral.

33. An apparatus according to claim 30, wherein said heater is fixed uring its fixing operation, and siad film slides on siad heater.

34. An apparatus according to claim 29, wherein during a fixing operation, there is no air layer between siad heat generagtng layer and the toner image.

35. An apparatus according to claim 24, wherein siad shutting means includes a fuse which blows out when a curent therethrough exceeds a predetemrined level.

36. An apparatus according to claim 24, wherein said shutting means shuts the energization when the duty ratio exceeds a predetermined level.

* * * * *

UNITED STATES PATENT AND TRADEMARK OFFICE

CERTIFICATE OF CORRECTION

PATENT NO. : 5,225,874

DATED : July 6, 1993

INVENTOR(S) : SHOKYO KOH, ET AL.

It is certified that error appears in the above-indentified patent and that said Letters Patent is hereby corrected as shown below:

COVER PAGE

[56] References Cited, "4,811,828" should read --3,811,828--.

COLUMN 1 (Page 2)

Line 55, "objct" should read --object--; "inveton" should read --invention--; and "proivde" should read --provide--;

Line 58, "ariation" should read --variation--; "th" should read --the--; and "genrating" should read --generating--;

Line 59, "afurther" should read --a further--; "pesnet" should read --present--; and "invnetion" should read --invention--;

Line 61, "energiztaion" should read --energization--;

Line 63, "proivded" should read --provided--; and "fomring" should read --forming--;

Line 64, "generaing" should read --generating--;

Line 66, "imeage" should read --image--; and

Line 68, "suppyling" should read --supplying--.

UNITED STATES PATENT AND TRADEMARK OFFICE

CERTIFICATE OF CORRECTION

PATENT NO. : 5,225,874

DATED : July 6, 1993

INVENTOR(S) : SHOKYO KOH, ET AL.

It is certified that error appears in the above-indentified patent and that said Letters Patent is hereby corrected as shown below:

COLUMN 2

Line 2, "controllinfg" should read --controlling--;

Line 4, "anotehr" should read --another--; "thereis" should read --there is--; "provdied" should read --provided--; and "fixin" should read --fixing--;

Line 5, "apapratus" should read --apparatus--; and "alinear" should read --a linear--; and "genraitng" should read --generating--;

Line 6, "lyaer," should read --layer--; and "carryign" should read --carrying--;

Line 8, "pulsewissely" should read --pulsewisely--;

Line 10, "alyer" should read --layer--;

Line 11, "irresepctive" should read --irrespective--; and "temperaturae" should read --temperature--;

Line 13, "energiztaion." should read --energization--;

Line 14, "asepct" should read --aspect--, and "providied" should read --provided--;

Line 15, "lniear" should read --linear--;

UNITED STATES PATENT AND TRADEMARK OFFICE

CERTIFICATE OF CORRECTION

PATENT NO. : 5,225,874

DATED : July 6, 1993

INVENTOR(S) : SHOKYO KOH, ET AL.

It is certified that error appears in the above-indentified patent and that said Letters Patent is hereby corrected as shown below:

COLUMN 2 (continued)

Line 18, "genrating" should read --generating--; "laye" should read --layer--; and "thorugh" should read --through--;

Line 19, "erergizer" should read --energizer--;

Line 20, "generingt" should read --generating-- and "alyer," should read --layer,--;

Line 21, "tmepature" should read --temperature--; "siad" should read --said--; "wherin" should read --wherein--; and "erer-" should read --ener- --;

Line 23, "tmeperaure" should read --temperature--;

Line 24, "wherien" should read --wherein-- and "conveyirng" should read --conveying--;

Line 25, "mateial," should read --material-- and "siad" should read --said--;

Line 26, "energiztion" should read --energization--;

Line 29, "VpXTmas≤d." should read --VpXTmax≤d.--;

Line 31, "asepct" should read --aspect-- and "provded" should read --provided--;

UNITED STATES PATENT AND TRADEMARK OFFICE

CERTIFICATE OF CORRECTION

PATENT NO. : 5,225,874

DATED : July 6, 1993

INVENTOR(S) : SHOKYO KOH, ET AL.

It is certified that error appears in the above-indentified patent and that said Letters Patent is hereby corrected as shown below:

COLUMN 2 (continued)

Line 32, "togehter" should read --together--;
Line 34, "ehater" should read --heater--;
Line 36, "theheat" should read --the heat-- and "generagting" should read --generating--;
Line 37, "generaign" should read --generating--;
Line 41, "siad" should read --said--;
Line 42, "accordane" should read --according-- and "siad" should read --said--;
Line 43, "objcts," should read --objects,--;
Line 44, "pesetn" should read --present--; "wil" should read --will--; "lbecome" should read --become--; and "aparent" should read --apparent--;
Line 45, "folloiwng" should read --following--;
Line 46, "emboidmnets" should read --embodiments--; "prsent" should read --present--; and "invnetion" should read --invention--;
Line 46, "accompnaying" should read --accompanying--;

UNITED STATES PATENT AND TRADEMARK OFFICE

CERTIFICATE OF CORRECTION

PATENT NO. : 5,225,874

DATED : July 6, 1993

INVENTOR(S) : SHOKYO KOH, ET AL.

It is certified that error appears in the above-indentified patent and that said Letters Patent is hereby corrected as shown below:

COLUMN 2 (continued)

Line 48, "DRAIWNGS" should read --DRAWINGS--;
Line 50, "diagrm" should read --diagram--;
Line 51, "emboidment" should read --embodiment--;
"persent" should read --present--; and
"inventon." should read --invention.--; and
Line 53, "acording" should read --according--;
"emboidment" should read --embodiment--; and
"inventon." should read --invention.--.

COLUMN 3

Line 61, "heatresistive" should read --heat-resistive--.

COLUMN 4

Line 50, "is" should read --are--;
Line 52, "R5, R7" should read --R5, R6, R7--; and
Line 63, "onsignal" should read --on-signal--.

UNITED STATES PATENT AND TRADEMARK OFFICE

CERTIFICATE OF CORRECTION

PATENT NO. : 5,225,874

DATED : July 6, 1993

INVENTOR(S) : SHOKYO KOH, ET AL.

It is certified that error appears in the above-indentified patent and that said Letters Patent is hereby corrected as shown below:

COLUMN 8

What is claimed is:

1. An image forming apparatus comprising:
a fixing heater;
a power source;
power supply means for supplying electric power in the form of pulses from said power source to said fixing heater, said power supply means controlling a width of the pulses in accordance with a voltage thereof; and
limiting means for limiting the width of the pulses.

2. An apparatus according to claim 1, further comprising a film movable together with a recording medium carrying thereon a toner image which is heated by heat generated by said heater through said film.

3. An apparatus according to claim 2, further comprising pressing means for imparting urging force among said heater, said film and the recording material.

It is certified that error appears in the above-indentified patent and that said Letters Patent is hereby corrected as shown below:

COLUMN 8 (continued)

4. An apparatus according to claim 3, wherein during a fixing operation, there is no air layer between said heat generating layer and the toner image.

5. An apparatus according to claim 2, wherein said heater comprises a linear heat generating layer for generating heat upon the supply of power thereto.

6. An apparatus according to claim 5, wherein said heat generating layer extends in a direction substantially perpendicular to a movement direction of said recording material.

7. An apparatus according to claim 5, wherein said heater is fixed during its fixing operation, and said film slides on said heater.

UNITED STATES PATENT AND TRADEMARK OFFICE

CERTIFICATE OF CORRECTION

PATENT NO. : 5,225,874

DATED : July 6, 1993

INVENTOR(S) : SHOKYO KOH, ET AL.

It is certified that error appears in the above-indentified patent and that said Letters Patent is hereby corrected as shown below:

COLUMN 9

8. An apparatus according to claim 1, wherein said supply means supplies the power to said heat generating layer in the form of pulses, and a width of the pulse is determined by a resistor, a capacitor and a reference voltage source in accordance with a pulse signal.

9. An apparatus according to claim 1, wherein said supply means supplies the power to said heat generating layer in the form of pulses, and said supply means controls a pulse width so as to make the power supplied to said heat generating layer substantially constant irrespective of the voltage level supplied thereto.

UNITED STATES PATENT AND TRADEMARK OFFICE

CERTIFICATE OF CORRECTION

PATENT NO. : 5,225,874

DATED : July 6, 1993

INVENTOR(S) : SHOKYO KOH, ET AL.

It is certified that error appears in the above-indentified patent and that said Letters Patent is hereby corrected as shown below:

COLUMN 9 (continued)

10. An image fixing apparatus, comprising:
a heater having a linear heat generating layer;
a film movable together with a recording material carrying thereon a toner image which is heated by heat generated by said heat generating layer through said film;
energizing means for pulsewisely energizing said heat generating layer wherein said energizing means supplies power to said heat generating layer in the form of pulses having the same pulse width irrespective of a temperature of said heater during energization by said energizing means; and
adjusting means for adjusting a pulse width of the pulsewise energization.

11. An apparatus according to claim 10, wherein said pulse width is adjusted in accordance with a resistance level of said heat generating layer.

UNITED STATES PATENT AND TRADEMARK OFFICE

CERTIFICATE OF CORRECTION

PATENT NO. : 5,225,874

DATED : July 6, 1993

INVENTOR(S) : SHOKYO KOH, ET AL.

It is certified that error appears in the above-indentified patent and that said Letters Patent is hereby corrected as shown below:

COLUMN 9

12. An apparatus according to claim 10, further comprising pressing means for imparting urging force among said heater, said film and the recording material.

13. An apparatus according to claim 12, wherein during a fixing operation, there is no air layer between said heat generating layer and the toner image.

14. An apparatus according to claim 10, wherein said heat generating layer extends in a direction substantially perpendicular to a movement direction of said recording material.

15. An apparatus according to claim 10, wherein said heater is fixed during its fixing operation, and said film slides on said heater.

CERTIFICATE OF CORRECTION

PATENT NO. : 5,225,874
DATED : July 6, 1993
INVENTOR(S) : SHOKYO KOH, ET AL.

It is certified that error appears in the above-indentified patent and that said Letters Patent is hereby corrected as shown below:

COLUMN 9 continued

16. An apparatus according to claim 10, wherein said adjusting means includes a variable resistor, and wherein the pulse width of the energization is adjusted by changing the resistance of the variable resistor.

17. An image fixing apparatus comprising:

a heater having a linear heat generating layer;

a film movable together with a recording material carrying thereon a toner image which is heated by heat generated by said heat generating layer through said film;

energizing means for pulsewisely energizing said heat generating layer;

temperature detecting means for detecting a temperature of said heater;

wherein said energizing means controls a period of energization pulse in accordance with an output of said temperature detecting means and wherein a conveying speed Vp of the recording material, a width of said heat generating layer d and energization period Tmax in which a minimum energy is supplied, satisfy:

$$Vp \times Tmax \leq d.$$

UNITED STATES PATENT AND TRADEMARK OFFICE

CERTIFICATE OF CORRECTION

PATENT NO. : 5,225,874

DATED : July 6, 1993

INVENTOR(S) : SHOKYO KOH, ET AL.

It is certified that error appears in the above-indentified patent and that said Letters Patent is hereby corrected as shown below:

COLUMNS 9 (continued) and 10

18. An apparatus according to claim 17, further comprising pressing means for imparting urging force among said heater, said film and the recording material.

19. An apparatus according to claim 18, wherein during a fixing operation, there is no air layer between said heat generating layer and the toner image.

20. An apparatus according to claim 17, wherein said heat generating layer extends in a direction substantially perpendicular to a movement direction of said recording material.

21. An apparatus according to claim 17, wherein said heater is fixed during its fixing operation, and said film slides on said heater.

UNITED STATES PATENT AND TRADEMARK OFFICE

CERTIFICATE OF CORRECTION

PATENT NO. : 5,225,874

DATED : July 6, 1993

INVENTOR(S) : SHOKYO KOH, ET AL.

It is certified that error appears in the above-indentified patent and that said Letters Patent is hereby corrected as shown below:

COLUMN 10 (continued)

22. An apparatus according to claim 17, wherein said energizing means controls a width of the pulsewise energization.

23. An apparatus according to claim 22, wherein the width of the pulsewise energization is controlled in accordance with variation of a voltage supplied thereto.

24. An image fixing apparatus, comprising:

a fixing heater;

power supply means for supplying electric power to said fixing heater;

control means for controlling the duty ratio of the power to said fixing heater by said power supply means; and shutting means for shutting off the power supply to said heater by said power supply means, wherein said shutting means shuts off the power supply to said heater in accordance with the duty ratio.

UNITED STATES PATENT AND TRADEMARK OFFICE

CERTIFICATE OF CORRECTION

PATENT NO. : 5,225,874

DATED : July 6, 1993

INVENTOR(S) : SHOKYO KOH, ET AL.

It is certified that error appears in the above-indentified patent and that said Letters Patent is hereby corrected as shown below:

COLUMN 10 (continued)

25. An apparatus according to claim 24, wherein said supply means supplies the power in the form of pulses, and said control means controls width of the pulses.

26. An apparatus according to claim 25, further comprising temperature detecting means for detecting a temperature of said heater, and the energization pulse time is changed in accordance with an output of said temperature detecting means.

27. An apparatus according to claim 25, wherein said shutting means shuts the energization when the pulse energization time exceeds a predetermined level.

28. An apparatus according to claim 24, wherein said shutting means is disposed in a power supply passage by said energizing means to said heater, and it shuts the power supply by opening the passage.

UNITED STATES PATENT AND TRADEMARK OFFICE

CERTIFICATE OF CORRECTION

PATENT NO. : 5,225,874

DATED : July 6, 1993

INVENTOR(S) : SHOKYO KOH, ET AL.

It is certified that error appears in the above-indentified patent and that said Letters Patent is hereby corrected as shown below:

COLUMN 10 (continued)

29. An apparatus according to claim 24, further comprising a film movable together with a recording medium carrying thereon a toner image which is heated by heat generated by said heater through said film.

30. An apparatus according to claim 29, wherein said heater includes a linear heat generating layer.

31. An apparatus according to claim 30, further comprising pressing means for imparting urging force among said heater, said film and the recording material.

32. An apparatus according to claim 30, wherein said heat generating layer extends in a direction substantially perpendicular to a movement direction of said recording material.

UNITED STATES PATENT AND TRADEMARK OFFICE

CERTIFICATE OF CORRECTION

PATENT NO. : 5,225,874

DATED : July 6, 1993

INVENTOR(S) : SHOKYO KOH, ET AL.

It is certified that error appears in the above-indentified patent and that said Letters Patent is hereby corrected as shown below:

COLUMN 10 (continued)

33. An apparatus according to claim 30, wherein said heater is fixed during its fixing operation, and said film slides on said heater.

34. An apparatus according to claim 29, wherein during a fixing operation, there is no air layer between said heat generating layer and the toner image.

35. An apparatus according to claim 24, wherein said shutting means includes a fuse which blows out when a current therethrough exceeds a predetermined level.

36. An apparatus according to claim 24, wherein said shutting means shuts the energization when the duty ratio exceeds a predetermined level.

Signed and Sealed this

Seventh Day of June, 1994

Bruce Lehman

*Attest:*

BRUCE LEHMAN

*Attesting Officer*

*Commissioner of Patents and Trademarks*